US009341421B2

(12) United States Patent
Findlay

(10) Patent No.: US 9,341,421 B2
(45) Date of Patent: May 17, 2016

(54) RIFLE HAVING A FIXED MAGAZINE

(71) Applicant: Smith & Wesson Corp., Springfield, MA (US)

(72) Inventor: David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 24 days.

(21) Appl. No.: 14/185,138

(22) Filed: Feb. 20, 2014

(65) Prior Publication Data

US 2015/0233659 A1 Aug. 20, 2015

(51) Int. Cl.

| | |
|---|---|
| ***F41A 9/65*** | (2006.01) |
| ***F41A 9/01*** | (2006.01) |
| ***F41A 3/58*** | (2006.01) |
| *F41C 7/11* | (2006.01) |

(52) U.S. Cl.

CPC ... *F41A 9/01* (2013.01); *F41A 3/58* (2013.01); *F41A 9/65* (2013.01); *F41C 7/11* (2013.01)

(58) Field of Classification Search

CPC ..... F41A 9/61; F41A 9/64; F41A 9/65; F41A 9/69

USPC ..... 42/11, 17, 21, 24, 29, 33, 35, 37, 39, 7, 42/6, 49.01, 49.02, 50; 89/195, 197, 33.1; 124/45

See application file for complete search history.

(56) References Cited

U.S. PATENT DOCUMENTS

| | | | | |
|---|---|---|---|---|
| 458,824 | A | 1/1891 | Daudeteau | |
| 922,173 | A | 5/1909 | Lovelace | |
| 1,033,408 | A | 7/1912 | Johnson | |
| 1,828,108 | A | 10/1931 | Flowers | |
| 2,185,676 | A * | 1/1940 | Moneta | F41A 9/69 42/49.01 |
| 2,402,086 | A | 6/1946 | Rix | |
| 2,596,841 | A | 5/1952 | Davidson | |
| 2,735,206 | A * | 2/1956 | Butler | F41A 9/65 42/18 |
| 2,785,492 | A | 3/1957 | Smith | |
| 2,875,544 | A * | 3/1959 | Krieger | F41A 9/59 42/18 |
| 3,603,020 | A * | 9/1971 | Wiese | F41A 9/69 42/50 |
| 3,732,643 | A * | 5/1973 | Wells | F41A 17/38 42/50 |
| D286,669 | S | 11/1986 | Ballard et al. | |
| 4,850,127 | A | 7/1989 | Davis et al. | |
| 4,905,394 | A | 3/1990 | Predazzer | |
| 5,357,703 | A * | 10/1994 | Chesnut | F41A 17/38 42/50 |
| 5,806,224 | A | 9/1998 | Hager | |
| 6,739,082 | B2 | 5/2004 | Christensen | |
| 7,503,137 | B2 | 3/2009 | Filicietti | |
| 7,571,671 | B2 | 8/2009 | Engel | |
| 7,941,955 | B2 | 5/2011 | Stone | |
| 8,327,568 | B1 | 12/2012 | Lavergne et al. | |
| 2004/0020092 | A1 * | 2/2004 | Christensen | F41A 9/70 42/49.01 |
| 2014/0223790 | A1 * | 8/2014 | Wilson | F41A 9/65 42/49.01 |
| 2015/0052793 | A1 * | 2/2015 | Cassady | F41A 9/61 42/8 |

* cited by examiner

*Primary Examiner* — Jonathan C Weber
(74) *Attorney, Agent, or Firm* — Ballard Spahr LLP

(57) ABSTRACT

A fixed magazine for a rifle has a projecting boss that engages a cavity within the magazine well of the rifle. Once the magazine is inserted and the boss engages the cavity, the magazine is fixed and may not be removed from the rifle. The magazine is loaded by separating the upper receiver from the lower receiver and exposing the magazine opening, allowing it to receive rounds of ammunition.

21 Claims, 4 Drawing Sheets

RIFLE HAVING A FIXED MAGAZINE

FIELD OF THE INVENTION

This invention relates to rifles having fixed magazines.

BACKGROUND

Rifles having fixed magazines, such as the Krag-Jorgensen, Mauser K98, Lee-Enfield and M1 "Garand" were the dominant rifle designs of the late $19^{th}$ and early to mid $20^{th}$ Centuries until they were supplanted by the now ubiquitous detachable magazine rifles whose design heritage can be traced back to the lesser known Stumgewehr 44.

Although the detachable magazine rifle boasts numerous advantages, particularly for military applications, the fixed magazine rifle is still thought to be a design particularly suited to sportsmen for hunting, target, and recreational shooting. The integral nature of the fixed magazine design provides a reliable and complete shooting platform which only needs ammunition to function. There is clearly a place among modern sporting rifles for a fixed magazine design which combines the simplicity, reliability and light weight of modern rifles with the advantages of this $19^{th}$ century development.

SUMMARY

The invention concerns rifles having fixed magazines. In one example embodiment, the invention comprises, in combination, a rifle and a magazine for ammunition. In this example, the rifle comprises a magazine well having an inwardly facing surface defining a space for receiving the magazine. At least one cavity is positioned in the inwardly facing surface. The magazine, by way of example, comprises a container having an opening for receiving the ammunition. The container has an outwardly facing surface. At least a portion of the container is positionable within the magazine well. At least one boss is positioned on the portion of the container positionable within the magazine well. The at least one boss projects from the outwardly facing surface and is engageable within the at least one cavity to retain the magazine within the magazine well.

In a particular example embodiment, the at least one cavity comprises a groove in the inwardly facing surface. The groove may be oriented substantially parallel to a firing axis of the rifle. In one example embodiment, the at least one cavity comprises a first surface oriented angularly with respect to the inwardly facing surface and a second surface, contiguous with the first surface. The second surface is oriented substantially perpendicular to the inwardly facing surface.

In a further example, the second surface lies in a plane substantially parallel to a firing axis of the rifle. By way of example, the first surface is positioned between the second surface and the firing axis of the rifle. In another example embodiment, the second surface is positioned between the first surface and the firing axis of the rifle.

In another example embodiment, a plurality of the cavities are positioned in the inwardly facing surface. In a specific example, at least two of the cavities are arranged on opposite sides of the magazine well. In another example, at least two of the cavities are arranged on the same side of the magazine well.

Further by way of example, the at least one boss comprises a first surface oriented angularly with respect to the outwardly facing surface of the container, and a second surface, contiguous with the first surface. The second surface is oriented substantially perpendicular to the outwardly facing surface of the container in this example.

In a particular example, the second surface lies in a plane substantially parallel to a firing axis of the rifle when the portion of the magazine is positioned within the magazine well. Further by way of example, the first surface is positioned between the second surface and the opening of the container. In another example embodiment, the second surface is positioned between the first surface and the opening of the container.

In a specific example embodiment, the at least one boss has a shape that is complementary to a shape of the cavity. Further by way of example, the at least one boss comprises a louver. In a further example embodiment, a plurality of the bosses are positioned on the outwardly facing surface. In one particular example embodiment, at least two of the bosses are arranged on opposite sides of the container. In another example embodiment, at least two of the bosses are arranged on the same side of the container. In an example, the combination may further comprise a projection positioned on the outwardly facing surface for the magazine in spaced relation to the boss. By way of example, the projection may comprise a rib.

The invention further encompasses, in combination, a rifle and a magazine for ammunition. In this example embodiment, the rifle comprises a magazine well having an inwardly facing surface defining a space for receiving the magazine. At least one boss projects from the inwardly facing surface into the space. In this example, the magazine comprises a container having an opening for receiving the ammunition. The container has an outwardly facing surface. At least a portion of the container is positionable within the magazine well. At least one cavity is positioned in the outwardly facing surface of the portion of the container positionable within the magazine well. The at least one boss is engageable within the at least one cavity to retain the magazine within the magazine well in this example.

In a particular example embodiment, the at least one cavity comprises a groove in the outwardly facing surface. By way of further example, the groove is oriented substantially parallel to a firing axis of the rifle when the portion of the magazine is positioned within the magazine well.

In another example embodiment, the at least one cavity comprises a first surface oriented angularly with respect to the outwardly facing surface, and a second surface, contiguous with the first surface. The second surface is oriented substantially perpendicular to the outwardly facing surface in this example.

By way of further example, the second surface lies in a plane substantially parallel to a firing axis of the rifle when the portion of the magazine is positioned within the magazine well. Additionally by way of example, the second surface is positioned between the first surface and the opening of the container. In an example combination, the first surface is positioned between the second surface and the opening of the container.

Another example embodiment further comprises a plurality of the cavities positioned in the outwardly facing surface. In a specific example embodiment, at least two of the cavities are arranged on opposite sides of the container. In another example embodiment, at least two of the cavities are arranged on the same side of the container.

In an example embodiment according to the invention, the boss comprises a first surface oriented angularly with respect to the inwardly facing surface, and a second surface, contiguous with the first surface. The second surface is oriented substantially perpendicular to the inwardly facing surface. In a particular example embodiment, the second surface lies in a plane substantially parallel to a firing axis of the rifle. By way of further example, the second surface is positioned between the first surface and the firing axis of the rifle. In an example combination, the first surface may be positioned between the second surface and the firing axis of the rifle.

In a specific example of the invention the boss has a shape that is complementary to a shape of the cavity.

An example embodiment may further comprise a plurality of the bosses positioned on the inwardly facing surface of the magazine well. In a particular example, at least two of the bosses are arranged on opposite sides of the magazine well. In another example, at least two of the bosses are arranged on the same side of the magazine well. In an example combination, a projection is positioned on the outwardly facing surface of the magazine in spaced relation to the boss. By way of example, the projection may comprise a rib.

The invention also includes a magazine for holding and feeding ammunition to a rifle having a magazine well. In one example embodiment, the magazine comprises a container having an opening for receiving the ammunition. The container has an outwardly facing surface. At least a portion of the container is positionable within the magazine well. At least one boss is positioned on the outwardly facing surface of the portion of the container positionable within the magazine well. The at least one boss projects outwardly therefrom. In this example, the at least one boss has a first surface oriented angularly with respect to the outwardly facing surface of the container, and a second surface, contiguous with the first surface. The second surface is oriented substantially perpendicular to the outwardly facing surface of the container. In a particular example, the second surface lies in a plane substantially parallel to a firing axis of the rifle when the portion of the magazine is positioned within the magazine well. In another example, the first surface is positioned between the second surface and the opening of the container. In another example, the second surface is positioned between the second surface and the opening of the container.

In one example embodiment, a plurality of the bosses are positioned on the outwardly facing surface. By way of further example, at least two of the bosses are arranged on opposite sides of the container. In another example, at least two of the bosses are arranged on the same side of the container. In a specific example embodiment, the at least one boss comprises a louver. In a further example, the magazine comprises a projection on an outwardly facing surface. By way of example, the projection comprises a rib.

Additionally, the invention contemplates a magazine for holding and feeding ammunition to a rifle having a magazine well. In one example embodiment, the magazine comprises a container having an opening for receiving the ammunition. The container has an outwardly facing surface. At least a portion of the container is positionable within the magazine well. In this example, at least one cavity is positioned in the outwardly facing surface of the portion of the container positionable within the magazine well. The at least one cavity has a first surface oriented angularly with respect to the outwardly facing surface of the container, and a second surface, contiguous with the first surface. The second surface is oriented substantially perpendicular to the outwardly facing surface of the container.

By way of example, the second surface lies in a plane substantially parallel to a firing axis of the rifle when the portion of the magazine is positioned within the magazine well. In a further example, the second surface is positioned between the first surface and the opening of the container.

In another example, the magazine comprises a plurality of the cavities positioned in the outwardly facing surface. In a particular example, at least two of the cavities are arranged on opposite sides of the container. In another example, at least two of the cavities are arranged on the same side of the container. In an example embodiment, the magazine comprises a projection positioned on an outwardly facing surface in spaced relation to the boss. In an example embodiment, the projection comprises a rib.

DETAILED DESCRIPTION

Figure 1:
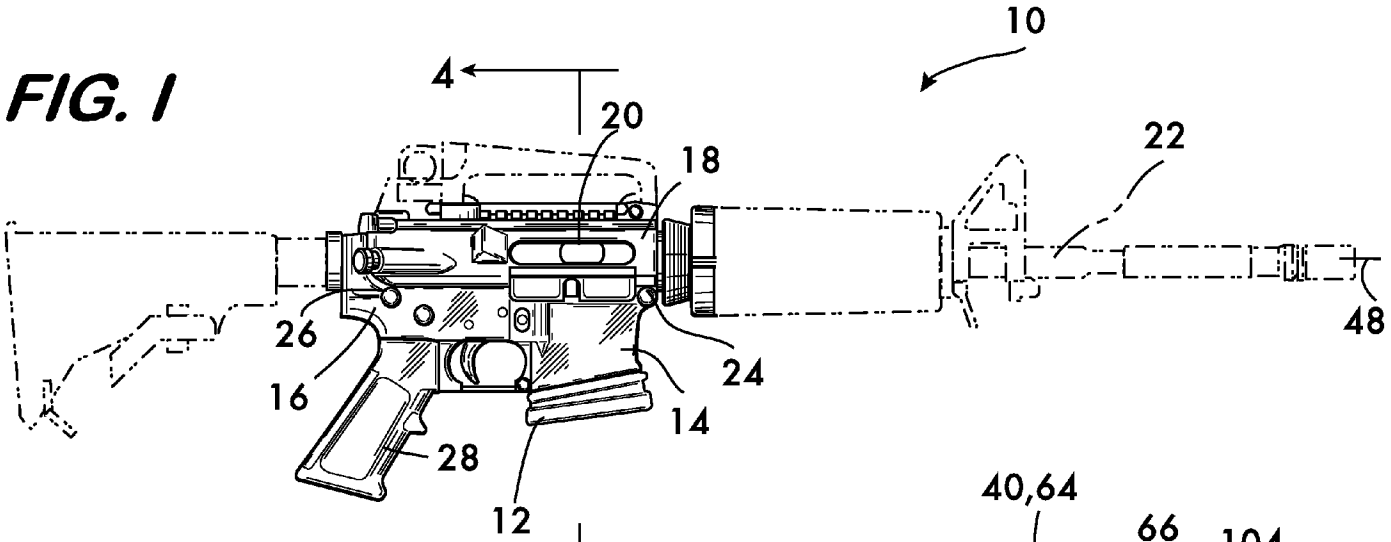
FIG. 1 is a side view of an example embodiment of a rifle and fixed magazine combination according to the invention.
Figure 8:
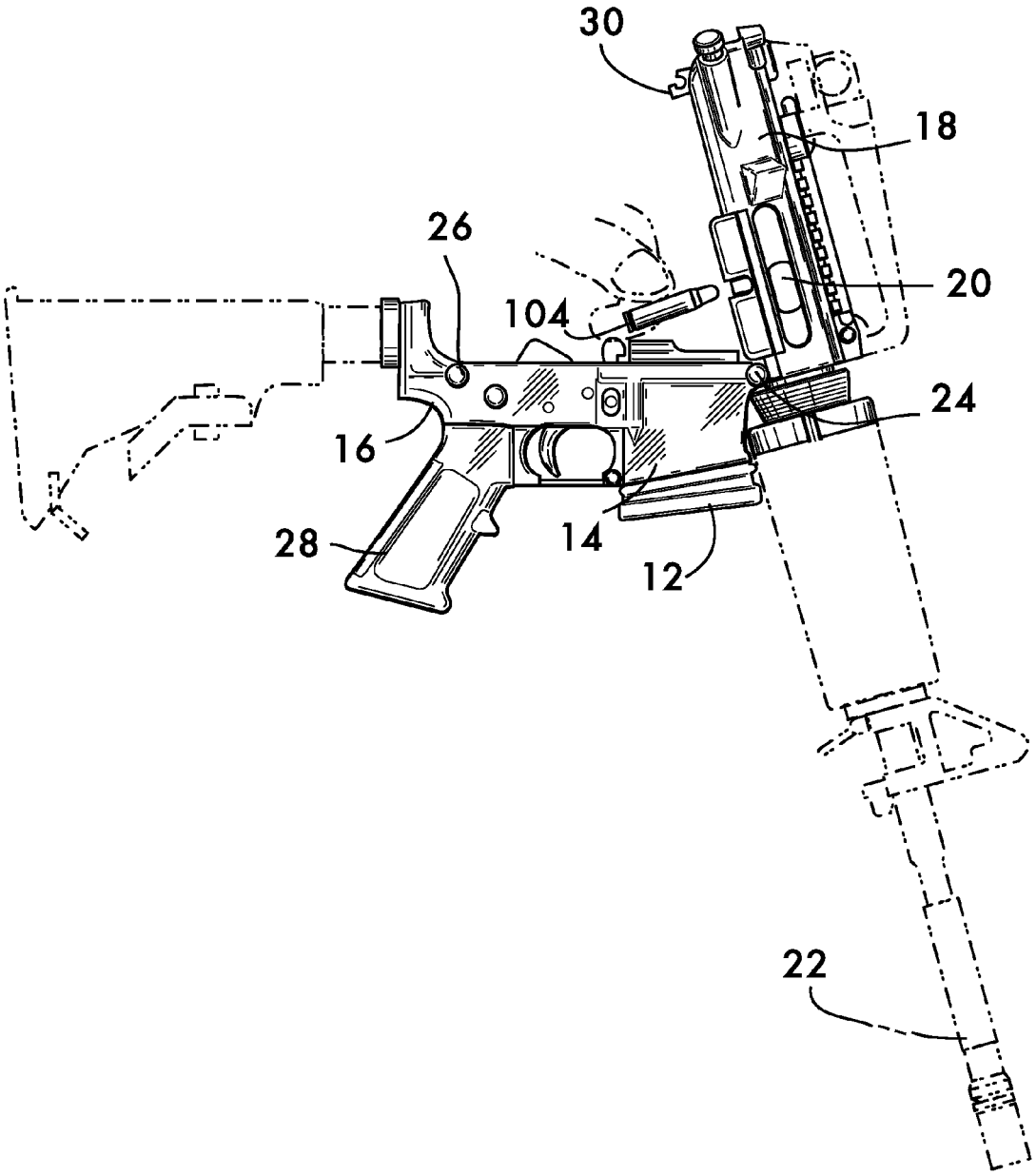
FIG. 8 is a side view of the example combination rifle/fixed magazine embodiment of FIG. 1 shown being loaded.

FIG. 1 shows an example rifle 10 having a fixed ammunition magazine 12 according to the invention. Magazine 12 is received within a magazine well 14, part of the lower receiver 16 of rifle 10. As shown in FIG. 8, an upper receiver 18, which includes the bolt carrier 20 and barrel 22, is pivotably attached to the lower receiver via a pivot pin 24 located adjacent to the magazine well 14. A cross pin 26, located in the lower receiver 16 adjacent to the rifle grip 28, cooperates with a lug 30 on the upper receiver 18 and, with the pivot pin 24, holds the upper and lower receiver together as shown in FIG. 1. As shown in FIG. 8, removal of the cross pin 26 permits the upper receiver 18 to pivot on pivot pin 24 away from the lower receiver into an open configuration, thereby exposing the magazine 12 for loading as described below.

Figure 2:
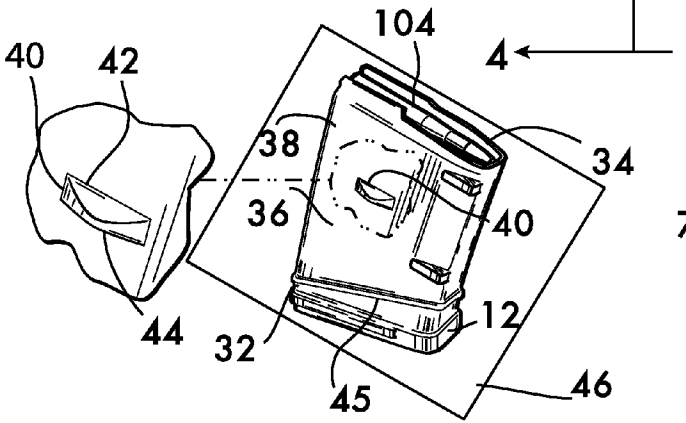
FIG. 2 is an isometric view of an example magazine used in the combination shown in FIG. 1.
Figure 4:
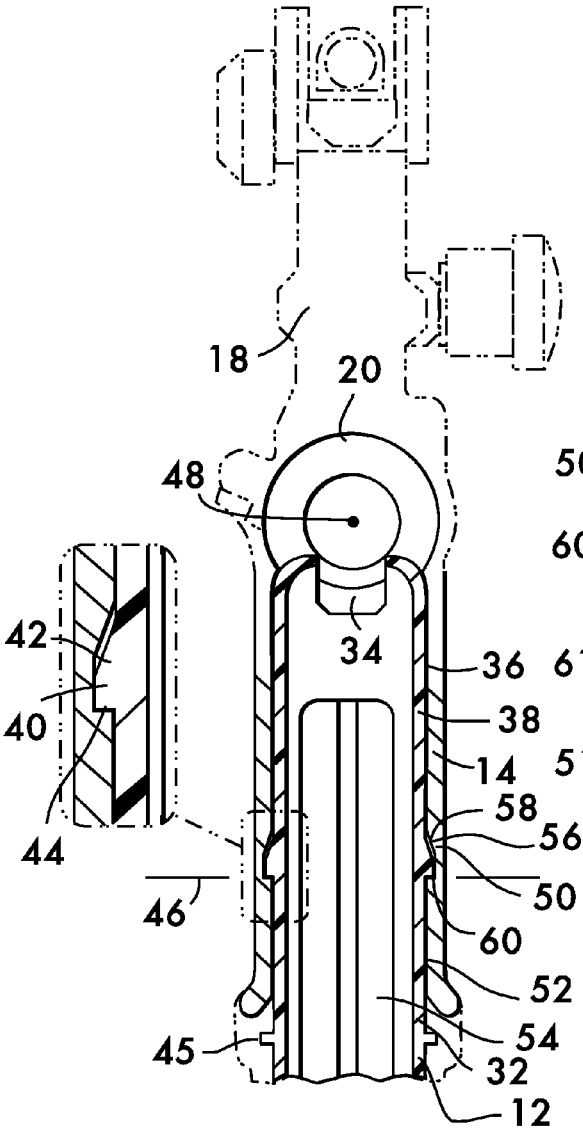
FIGS. 4 and 5 are cross sectional views of different embodiments of a combination rifle and fixed magazine taken at line 4-4 of FIG. 1.

FIG. 2 shows an example fixed magazine 12, which comprises a container 32 having an opening 34 for receiving ammunition. Although a magazine having a 10 round capacity is illustrated, it is understood that this is by way of example only, and magazine 12 may be sized to any practical capacity. At least a portion 36 of the container 32 surrounding the opening 34 is positionable within the magazine well 14. Opening 34 is thus exposed to receive ammunition when the upper receiver 18 is pivoted away from the lower receiver 16 into the open configuration shown in FIG. 8. With reference again to FIG. 2, magazine 12 has an outwardly facing surface 38. At least one boss 40 is positioned on outwardly facing surface 38 on the portion 36 of the container 32 positionable within the magazine well 14. In this example embodiment, boss 40 projects outwardly from magazine surface 38 and comprises a first surface 42 oriented angularly with respect to magazine surface 38, and a second surface 44, contiguous with the first surface 42 and oriented substantially perpendicularly to magazine surface 38. As shown in FIG. 4, the second surface 44 lies in a plane 46 that is substantially parallel to the firing axis 48 of the rifle 10 (see FIG. 1) when the magazine 12 is positioned within the magazine well 14.

First surface 42 is positioned between the opening 34 of the magazine 12 and the second surface 44, allowing it to act as a ramp to facilitate entry when the magazine 12 is inserted into the magazine well 14.

FIGS. 2 and 4 also show a projection in the form of a rib 45 that extends around and projects from the outwardly facing surface 38 of the container 32. The projection may take many different forms, but rib 45 is advantageous because it stiffens the lower part of the container 32 and engages the magazine well 14 to prevent the magazine 12 from being removed from the rifle 10 by passing it upwardly through the magazine well when the upper receiver 18 is pivoted away from the lower receiver 16 into the open configuration shown in FIG. 8.

As further shown in FIG. 4, boss 40 is received within a cavity 50 positioned in an inwardly facing surface 52 of the magazine well 14. Inwardly facing surface 52 defines the space 54 for receiving the magazine 12. In this example embodiment, cavity 50 comprises a groove 56 in inwardly facing surface 52 that is oriented substantially parallel to firing axis 48. It is advantageous that the cavity 50 and boss 40 have complementary cross sectional shapes. To that end, cavity 50 is defined by a first sub-surface 60 oriented substantially perpendicular to the inwardly facing surface 52, and a second sub-surface 58, oriented angularly with respect to inwardly facing surface 52 and contiguous with the first sub-surface 60. Second sub-surface 58 is positioned between the first sub-surface 60 and the firing axis 48 of the rifle 10.

When the boss 40, cavity 50 and rib 45 are configured as described, they cooperate to retain magazine 12 within magazine well 14 as a fixed magazine. When magazine 12 is inserted, the first angularly oriented boss surface 42 acts as a ramp and initiates entry of the magazine 12 into the magazine well 14 despite the interference between the projecting boss 40 and the inwardly facing surface 52. The container 32 is flexible and deforms elastically to permit insertion. When the boss 40 aligns with the cavity 50, the boss snaps into the cavity under the elastic force of the deformed container 32, the container returning to its undeformed shape. The cavity and boss are designed to engage each other to such a depth that there is sufficient positive mechanical engagement between the second boss surface 44 and the second cavity surface 60 so as to essentially prevent withdrawal of the magazine 12 from the magazine well 14. The boss 40 and cavity 50 are positioned on the magazine 12 and within the magazine well 14, respectively, so that the magazine opening 34 is positioned relatively to the bolt carrier 20 such that the magazine 12 presents rounds of ammunition to the bolt carrier so that it may strip a round from the magazine and chamber the round as the action of the rifle is cycled. Additionally, the rib 45 is designed to stiffen the magazine 12 to inhibit deflection, and engage a substantial portion of the magazine well 14 to prevent removal of the magazine 12 by passing it up through the magazine well when the upper and lower receivers 18 and 16 are pivoted to the open position of FIG. 8.

As shown in FIG. 4, it is advantageous to have multiple bosses 40 on magazine 12 and multiple cavities 50 within the magazine well 14. The use of multiple bosses and cavities increases the strength of the force retaining the magazine within the magazine well while allowing the use of smaller bosses that cause less deflection of the container upon insertion into the magazine well. This, in turn, permits a stiffer magazine to be used. Single as well as multiple bosses 40 may be positioned on one or on opposite sides of the magazine to engage similarly arrayed cavities on the inwardly facing surface 52 of the magazine well 14.

Figure 3:
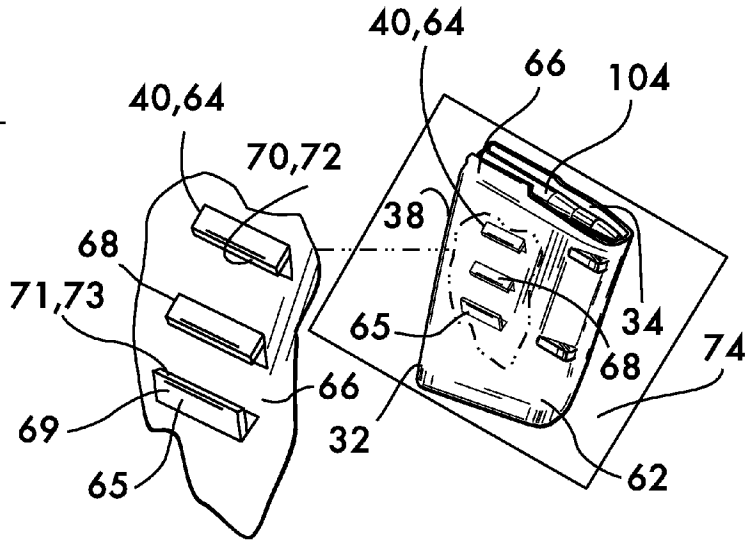
FIG. 3 is an isometric view of another example magazine used in the combination shown in FIG. 1.
Figure 5:
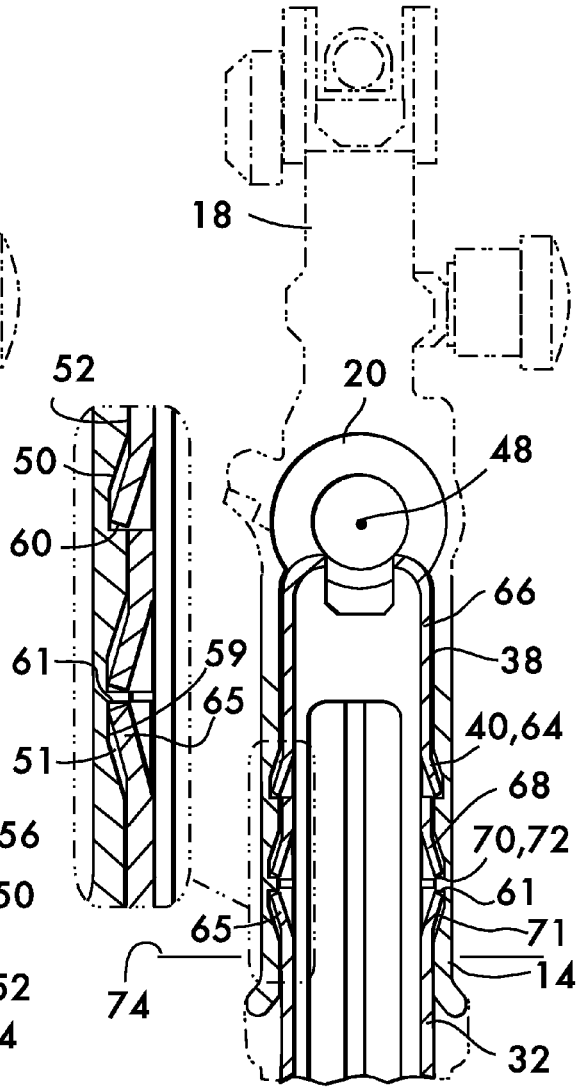

FIGS. 3 and 5 show another magazine embodiment 62 having bosses 40 in the form of louvers 64. Louvers 64 are well suited to fabrication in metal magazines and are formed by lancing or punching the sidewall 66 of the container 32. This process shears the metal and permanently deforms it into a projection having a first surface 68 oriented angularly with respect to the outwardly facing surface 38 of container 32, and a second surface 70, formed by the free edge 72 of the sheared sidewall 66. Second surface 70 is contiguous with the first surface and is oriented substantially perpendicular to the outwardly facing surface 38 of the container 32. Second surface 70 also lies in a plane 74 parallel to the firing axis 48 of the rifle 10 when the magazine 62 is received within the magazine well 14. The first surface 68 is positioned between the second surface 70 and the opening 34 of the container 32. As shown in FIG. 5, louvers 64 engage cavities 50 in the inwardly facing surface 52 of the magazine well 14, with interaction between second surface 70 of the louver and the second surface 60 of the cavity preventing withdrawal of the magazine from the magazine well in the direction away from the upper receiver 18. Single as well as multiple louvers 64 may be positioned on the same side as well as opposite sides of magazine 12 as shown.

To prevent removal of the magazine 62 by pushing it upwardly through the magazine well 14 when the upper and lower receivers 18 and 16 are pivoted to the open position, it is advantageous to reverse the configuration of at least one of the louvers as shown at 65 in FIGS. 3 and 5. The reversed louvers 65 have a first surface 69 oriented angularly with respect to the outwardly facing surface 38 of container 32, and a second surface 71, formed by the free edge 73 of the sheared sidewall 66. Second surface 71 is contiguous with the first surface 69 and is oriented substantially perpendicularly to the outwardly facing surface 38 of the container 32. Second surface 71 also lies in plane 74 parallel to the firing axis 48 of the rifle 10 when the magazine 62 is received within the magazine well 14. In the reversed louver 65, the second surface 71 is positioned between the first surface 69 and the opening 34 of the container 32. As shown in FIG. 5, reversed louvers 65 engage cavities 51 in the inwardly facing surface 52 of the magazine well 14. Cavities 51 are also reversed, i.e., they have a complementary shape to receive the reversed louvers 65, with first and second surfaces 59 and 61 defining the reversed cavities 51. Interaction of the second surfaces 71 of the reversed louvers 65 with the second surfaces 61 of the reversed cavities 51 provides mechanical engagement that prevents the magazine 62 from being removed upwardly through the magazine well.

Figure 6:
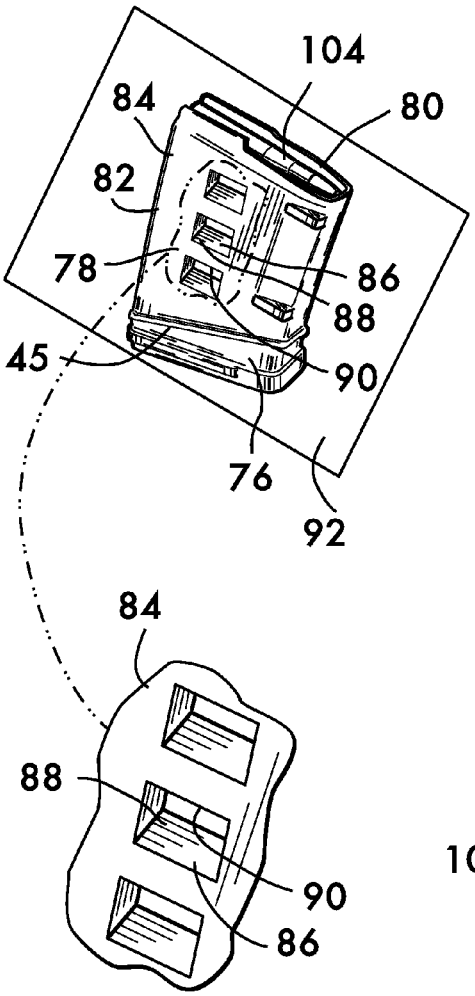
FIG. 6 is an isometric view of another example magazine used in the combination shown in FIG. 1.
Figure 7:
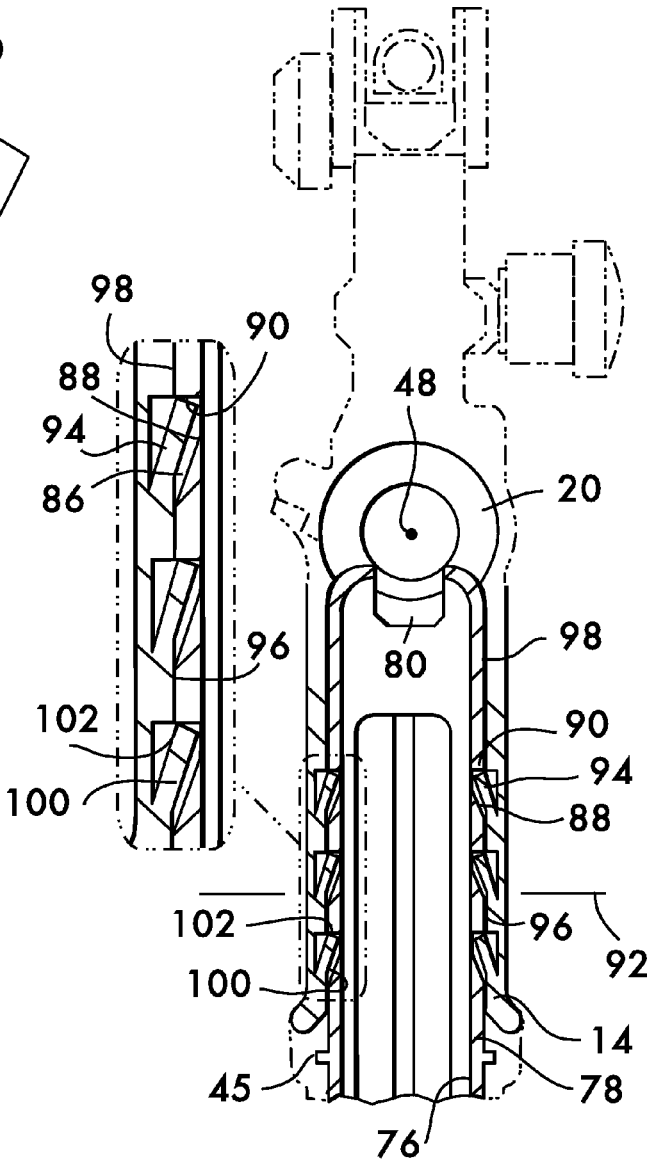
FIG. 7 is a cross sectional view of another example embodiment of a combination of the magazine shown in FIG. 6 and a rifle according to the invention.

FIGS. 6 and 7 show another example fixed magazine 76, which comprises a container 78 having an opening 80 for receiving ammunition. At least a portion 82 of the container 78 surrounding the opening 80 is positionable within the magazine well 14 of the rifle 10. Opening 80 is thus exposed to receive ammunition when the upper receiver 18 is pivoted away from the lower receiver 16 into the open configuration shown in FIG. 8. With reference again to FIG. 6, magazine 76 has an outwardly facing surface 84. At least one cavity 86 is positioned on outwardly facing surface 84 on the portion 82 of the container 78 positionable within the magazine well 14. In this example embodiment, cavity 86 extends inwardly from magazine surface 84 and comprises a first surface 88 oriented angularly with respect to magazine surface 84, and a second surface 90, contiguous with the first surface 88 and oriented substantially perpendicularly to magazine surface 84. As shown in FIG. 7, the second surface 90 lies in a plane 92 that is substantially parallel to the firing axis 48 of the rifle 10 (see FIG. 1) when the magazine 76 is positioned within the magazine well 14. Second surface 90 is positioned between the opening 80 of the magazine 76 and the first surface 88.

As further shown in FIG. 7, a boss 94 is received within cavity 86 when magazine 76 is inserted within the magazine well 14. Boss 94 is positioned on an inwardly facing surface 96 of the magazine well 14. Inwardly facing surface 96 defines the space 98 for receiving the magazine 76. It is advantageous that the cavity 86 and boss 94 have complementary cross sectional shapes. To that end, boss 94 is defined by a first surface 100 oriented angularly with respect to inwardly facing surface 96, and a second surface 102, contiguous with the first surface 100, and oriented substantially perpendicular to the inwardly facing surface 96. Second surface 102 is positioned between the first surface 100 and the firing axis 48 of the rifle 10, allowing it to act as a ramp to facilitate entry when the magazine 76 is inserted into the magazine well 14.

When the boss 94 and cavity 86 are configured as described, they cooperate to retain magazine 76 within magazine well 14 as a fixed magazine. When magazine 76 is inserted, the first angularly oriented boss surface 100 acts as a ramp and initiates entry of the magazine 76 into the magazine well 14 despite the interference between the projecting boss 94 and the outwardly facing surface 84 of the magazine. The container 78 is flexible and deforms elastically to permit insertion. When the boss 94 aligns with the cavity 86, the boss engages the cavity under the elastic force of the deformed container 78, the container returning to its undeformed shape. The cavity and boss are designed to engage each other to such a depth that there is sufficient positive mechanical engagement between the second boss surface 102 and the second cavity surface 90 so as to essentially prevent withdrawal of the magazine 76 from the magazine well 14. The boss 94 and cavity 86 are positioned on the magazine 76 and within the magazine well 14, respectively, so that the magazine opening 80 is positioned relatively to the bolt carrier 20 such that the magazine 76 presents rounds of ammunition to the bolt carrier so that it may strip a round from the magazine and chamber the round as the action of the rifle is cycled.

As shown in FIGS. 6 and 7, it is advantageous to have multiple bosses 94 on the inwardly facing surface 96 of the magazine well 14, and multiple cavities 86 in the outwardly facing surface 84 of the magazine 76. The use of multiple bosses and cavities increases the strength of the force retaining the magazine within the magazine well while allowing the use of smaller bosses that cause less deflection of the container upon insertion into the magazine well. This, in turn, permits a stiffer magazine to be used. Single as well as multiple bosses 94 may be positioned on one or on opposite sides of the magazine well to engage similarly arrayed cavities on the outwardly facing surface 84 of the magazine 76.

FIG. 8 illustrates a method of loading the rifle 10 when any of the magazine embodiments 12, 62 and 76 are used. Because the magazine, once inserted into the magazine well 14, is essentially fixed and not removable from the rifle, access to the magazine opening (for example, opening 34 in container 32 comprising magazine 12) is afforded only by disengaging the cross pin 26 from lug 30 and pivoting the upper receiver 18 relatively to the lower receiver 16 on pivot pin 24 to expose the opening 34 and permit rounds of ammunition 104 to be inserted into the magazine 12. Once the desired number of rounds are inserted the upper receiver 18 is pivoted back into engagement with the lower receiver 16, the cross pin 26 is reengaged with lug 30. A round 104 may then be chambered (if necessary) by cycling the bolt carrier and the rifle is ready to fire.

What is claimed is:

1. In combination, a rifle and a magazine for ammunition, said rifle comprising:

a magazine well having an inwardly facing surface defining an aperture for receiving said magazine;

at least one cavity positioned in said inwardly facing surface, said at least one cavity being defined by a plurality of sub-surfaces;

said magazine comprising:

a container having an opening for receiving said ammunition, said container having an outwardly facing surface, at least a portion of said container being positionable within said magazine well;

at least one boss positioned on said portion of said container positionable within said magazine well, said at least one boss projecting from said outwardly facing surface and being engageable within said at least one cavity, a first sub-surfaces being positioned between said boss and said aperture, said first sub-surfaces being immovable to prevent removal of said magazine from said magazine well.

2. The combination according to claim 1, wherein said at least one cavity comprises a groove in said inwardly facing surface.

3. The combination according to claim 2, wherein said groove is oriented substantially parallel to a firing axis of said rifle.

4. The combination according to claim 1, wherein said at least one cavity comprises:

a second sub-surface oriented angularly with respect to said inwardly facing surface; and a third sub-surface, contiguous with said second sub-surface, said third sub-surface being oriented substantially perpendicular to said inwardly facing surface.

5. The combination according to claim 4, wherein said third sub-surface lies in a plane substantially parallel to a firing axis of said rifle.

6. The combination according to claim 5, wherein said second sub-surface is positioned between said third sub-surface and said firing axis of said rifle.

7. The combination according to claim 5, wherein said third sub-surface is positioned between said second sub-surface and said firing axis of said rifle.

8. The combination according to claim 1, further comprising a plurality of said cavities positioned in said inwardly facing surface.

9. The combination according to claim 8, wherein at least two of said cavities are arranged on opposite sides of said magazine well.

10. The combination according to claim 8, wherein at least two of said cavities are arranged on the same side of said magazine well.

11. The combination according to claim 1, wherein said at least one boss comprises:

a first surface oriented angularly with respect to said outwardly facing surface of said container; and a second surface, contiguous with said first surface, said second surface being oriented substantially perpendicular to said outwardly facing surface of said container.

12. The combination according to claim 11, wherein said second surface lies in a plane substantially parallel to a firing axis of said rifle when said portion of said magazine is positioned within said magazine well.

13. The combination according to claim 12, wherein said first surface is positioned between said second surface and said opening of said container.

14. The combination according to claim 12, wherein said second surface is positioned between said first surface and said opening of said container.

15. The combination according to claim 1, wherein said at least one boss has a shape that is complementary to a shape of said cavity.

16. The combination according to claim 1, wherein said at least one boss comprises a louver.

17. The combination according to claim 1, further comprising a plurality of said bosses positioned on said outwardly facing surface.

18. The combination according to claim 17, wherein at least two of said bosses are arranged on opposite sides of said container.

19. The combination according to claim 17, wherein at least two of said bosses are arranged on the same side of said container.

20. The combination according to claim 1, further comprising a projection positioned on said outwardly facing surface of said magazine in spaced relation to said boss.

21. The combination according to claim 20, wherein said projection comprises a rib.

* * * * *